US005853086A

United States Patent [19]

Chang

[11] Patent Number: 5,853,086

[45] Date of Patent: Dec. 29, 1998

[54] PARTITIONING BRACKET ASSEMBLY FOR A GOLF CLUB BAG

[76] Inventor: Chen-Te Chang, No. 6, Lane 49, Jen-I St., Wu-Jih Hsiang, Taichung Hsien, Taiwan

[21] Appl. No.: 902,261

[22] Filed: Jul. 29, 1997

[51] Int. Cl.[6] ..... A63B 55/00

[52] U.S. Cl. ..... 206/315.6; 206/315.3

[58] Field of Search ..... 206/315.3, 315.6

[56] References Cited

U.S. PATENT DOCUMENTS

| | | | |
|---|---|---|---|
| 1,417,380 | 5/1922 | Hatch | 206/315.6 |
| 1,731,588 | 10/1929 | Patterson | 206/315.6 |
| 3,554,255 | 1/1971 | Mangan | 206/315.6 |
| 5,267,660 | 12/1993 | Kwon | 206/315.6 X |
| 5,383,555 | 1/1995 | Weinmeier | 206/315.6 |
| 5,509,531 | 4/1996 | Patrick et al. | 206/315.6 |
| 5,511,660 | 4/1996 | Yamada et al. | 206/315.3 X |
| 5,617,951 | 4/1997 | Wick | 206/315.6 |
| 5,620,091 | 4/1997 | Larson | 206/315.6 |
| 5,636,734 | 6/1997 | Smith | 206/315.6 X |
| 5,636,735 | 6/1997 | Stusek | 206/315.6 |
| 5,725,095 | 3/1998 | Beck et al. | 206/315.3 X |

FOREIGN PATENT DOCUMENTS

| | | | |
|---|---|---|---|
| 2646785 | 1/1990 | France | 206/315.6 |

*Primary Examiner*—Sue A. Weaver
*Attorney, Agent, or Firm*—Bacon & Thomas, PLLC

[57] ABSTRACT

A partitioning bracket assembly for a conventional golf club bag having partitioning plates. A bracket unit is provided with a plurality of openings for separately receiving golf clubs. Each golf club may be first fixed in position by a fixing tab and then pressed by a retainer. The assembly prevents the clubs from colliding and interfering with each other, and individual clubs may be readily inserted in the bag and thereafter easily recognized, selected and withdrawn from the bag.

6 Claims, 13 Drawing Sheets

PARTITIONING BRACKET ASSEMBLY FOR A GOLF CLUB BAG

BACKGROUND OF THE INVENTION

1. Field of the Invention

The present invention relates to a partitioning bracket assembly, and more particularly, to a partitioning bracket assembly for a golf club bag. The partitioning bracket assembly is attached to the golf club bag and is provided with a plurality of openings and each of the openings is ready for receiving a golf club therein. Each of the golf clubs can be further secured such that the golf clubs will not move around within the partitioning bracket unit.

2. Description of the Prior Art

When striking a ball, a most suitable golf club shall be selected to get the exact strike. However, selecting a suitable golf club is dependent on the following factors: striking angle, distance, par, wind, rain, terrain, etc. Accordingly, about 12 to 14 golf clubs have been provided for the different strike requirements. Each of the 14 golf clubs has a special angle and length on its head and shaft. Those 14 golf clubs are received and disposed within a golf club bag for carrying.

Referring to FIG. 1, the conventional golf club bag is provided with a bag body which can stand vertically. The inner space of the bag body is divided into six (6) receiving chambers by means of two traverse partitioning plates and a longitudinal partitioning plate. These partitioning plates are made from hard board covered with a fabric. Each of those six receiving chambers is ready for receiving two to three (2–3) golf clubs. However, the actual storage of the clubs may not be exactly as described. For example, when the golfer plays, the caddie controls the retrieving and storing of the golf clubs and the caddie may conduct this procedure according to his/her own preference. As a result, the front receiving chambers are normally crowded with more than three golf clubs which will collide, and interfere with each other. Even the putter may be suspended without touching the bottom of the bag body.

Accordingly, it is easy to take an incorrect golf club since it is difficult to recognize the putter from the other irons and woods. When an incorrect golf club is selected, it will be difficult to get a good strike. Besides, since all the golf clubs are disposed randomly, the golf clubs may become entangled with each other. It thus will be difficult to select and withdraw a desired club. Unless the entangling is cleared, the desired golf club is impossible to remove. This trivial and inconvenient way of removing the golf club may considerably influence the mood of playing and final results of the game.

In order to solve the problem described above, a partitioning pack has been provided, as clearly shown in FIG. 2. The partitioning pack is configured by soft loop, connecting ring and golf club partitions. The soft loop is integrally molded from resilient material and configured with an oval shape. The soft loop is provided with a plurality of recesses for partitioning the golf clubs. The soft loop is further enveloped onto the connecting ring which has an oval board of a given thickness. The connecting ring is further connected to the bag body. However, this conventional design may still have the following defects. The golf club partitions are configured with seven (7) recesses and each of the recesses is intended to receive two (2) golf clubs therein. However, the caddie will not put the golf clubs according to the design principle. As a result, more than two (2) golf clubs have been inserted into a single recess. Consequently, there exists interference and collision among the clubs and it is difficult to recognize and withdraw the desired golf club.

These conventional problems remain unsolved. Furthermore, this partitioning pack can not be directly installed onto an existing bag body. If the golfer hopes to use this partitioning pack, a special golf bag must be tailored and this partitioning pack must be stitched onto the tailored bag. The overall cost is quite high and the golfer having a conventional bag can not use this partitioning pack. Besides, sharp edges are formed between the inner and top surfaces of the partitioning, so in order to prevent the shaft of the golf club from being scratched by the edges, it is suggested to dispose the golf clubs vertically, a procedure that is difficult to accomplish.

SUMMARY OF THE INVENTION

It is the objective of this invention to provide a partitioning bracket assembly for a golf club bag. A partitioning bracket unit is attached to the partitioning plates of the bag and is provided with a plurality of openings. In the preferred embodiment, about fourteen openings are provided. Each of the openings receives a golf club and each club is disposed therein according to the length of the shaft of the club. Accordingly, each of the golf clubs is independently disposed without colliding, interfering, and crossing with each other. On the other hand, each of the golf clubs can be readily withdrawn from the bag. Because each of the golf clubs can be readily recognized by its length, the user may correctly take the desired club for an intended strike. Furthermore, the total number of clubs can be readily counted. Besides, the partitioning bracket unit can be readily attached to an existing golf club bag and the user may conduct the assembling in a do-it-yourself manner.

According to another aspect of the present invention, each of the golf clubs may be further secured in position by a fixing tab and retainer such that each of the golf clubs can be firmly positioned without colliding all around. Regardless if the bag is disposed vertically, horizontally, or at a slant, each of the golf clubs is firmly positioned against movement. The assembling and disassembling of the fixing tab and retainer can be readily conducted.

In order to achieve the above objects, a partitioning bracket assembly is provided for a golf club bag in which the partitioning plates disposed at the top of the bag are provided with a partitioning bracket unit for receiving the golf clubs therein. The partitioning bracket unit is configured in a circular disk shape and is defined by a plurality of openings therein.

According to the preferred embodiment, fourteen openings are provided. Each of the openings is provided with a circular shape at the upper and lower portions and the inner periphery thereof. Each of the openings is ready for receiving one golf club therein. The partitioning bracket unit is provided with a pair of opposed retaining grooves at the periphery. Every three openings located at the middle and front area of the partitioning bracket is assigned to a sub-group and each sub-group is provided with a fixing tab for positioning the golf club which is disposed therein. The top surface of the fixing tab is provided with a handle for manipulation by the user. One side portion of the handle is provided with a retaining groove for retaining the shaft of the golf club therein. A retainer is further provided and a plurality of fixing tabs can be further positioned by the retainer. The retainer defines a pressing socket by which the fixing tabs are pressed. The pressing socket is further provided with a movable latch post. The latch post is provided with an oval flange corresponding to the oval hole of the partitioning bracket unit so that the latch post can be moved away from the lower position of the oval hole or is disposed thereunder.

BRIEF DESCRIPTION OF THE DRAWINGS

In order that the present invention may more readily be understood, the following detailed description is given, merely by way of example and with reference to the accompanying drawings in which.

DETAILED DESCRIPTION OF THE PREFERRED EMBODIMENT

Figure 1:
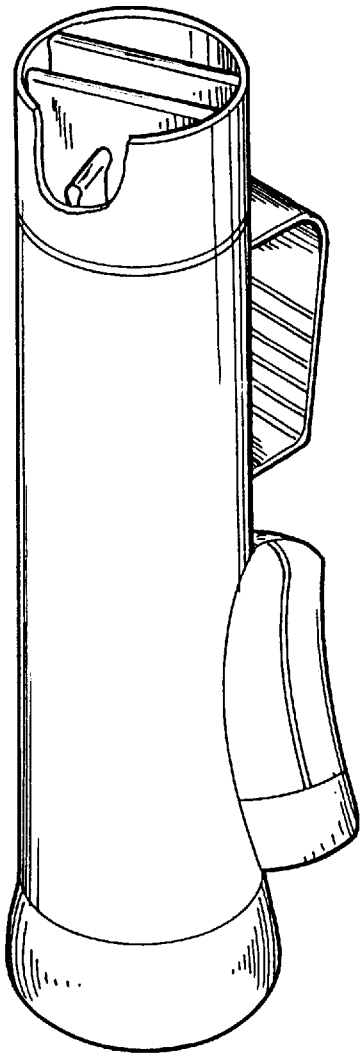
Fig.1 PRIOR ART
FIG. 1 is a perspective view of a conventional golf club bag.
Figure 2:
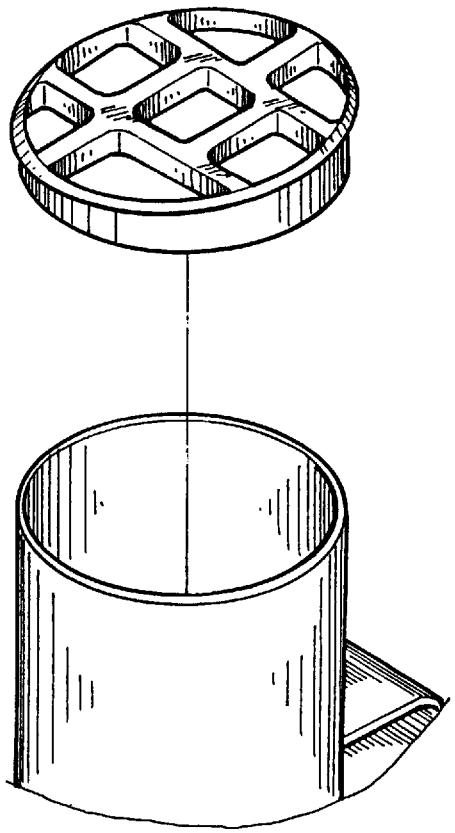
Fig.2 PRIOR ART
FIG. 2 is an exploded perspective view showing the conventional partitioning bracket and the golf club bag.
Figure 3:
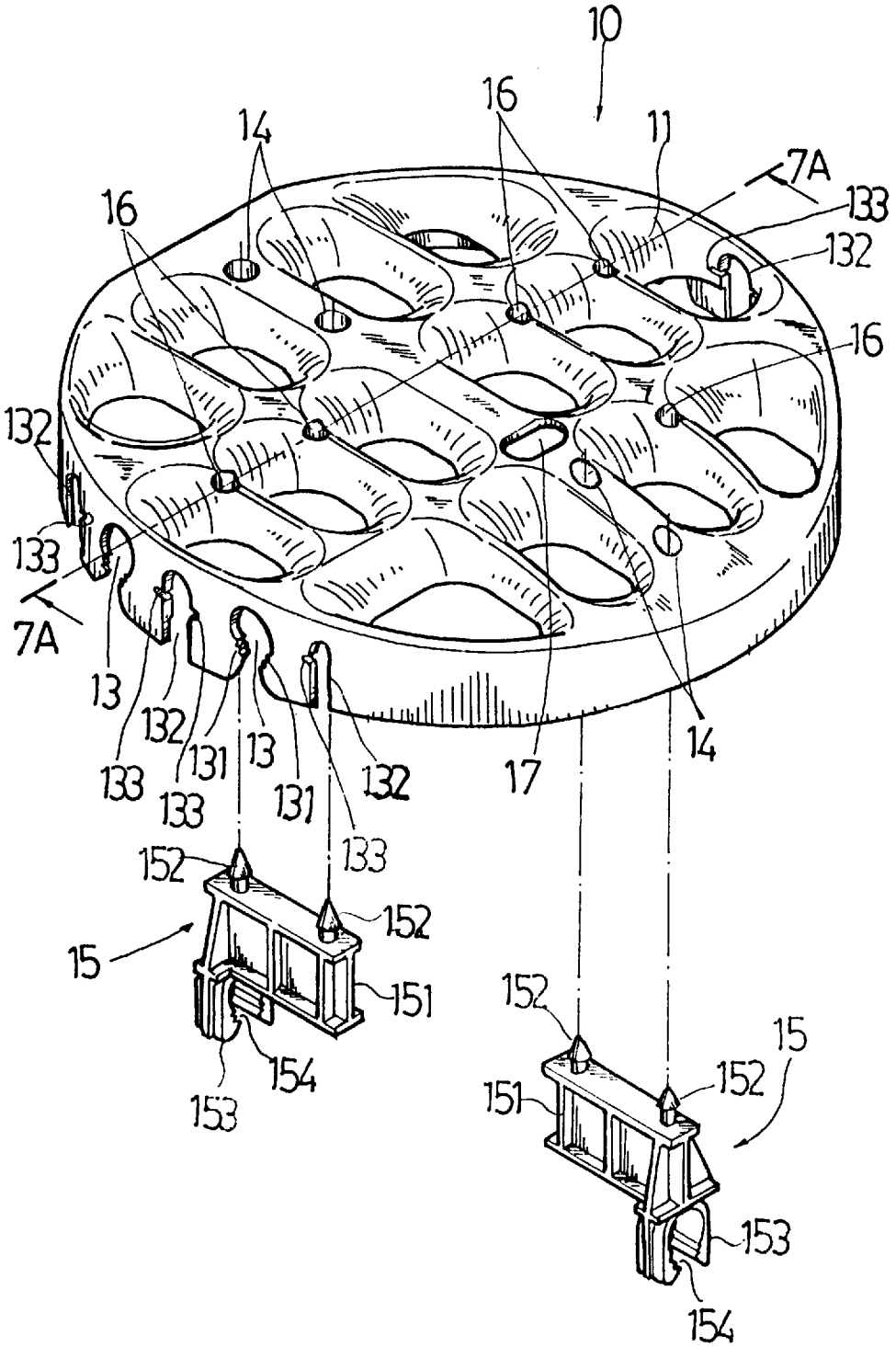
FIG. 3 is an exploded perspective view of the partitioning bracket according to the present invention.
Figure 4:
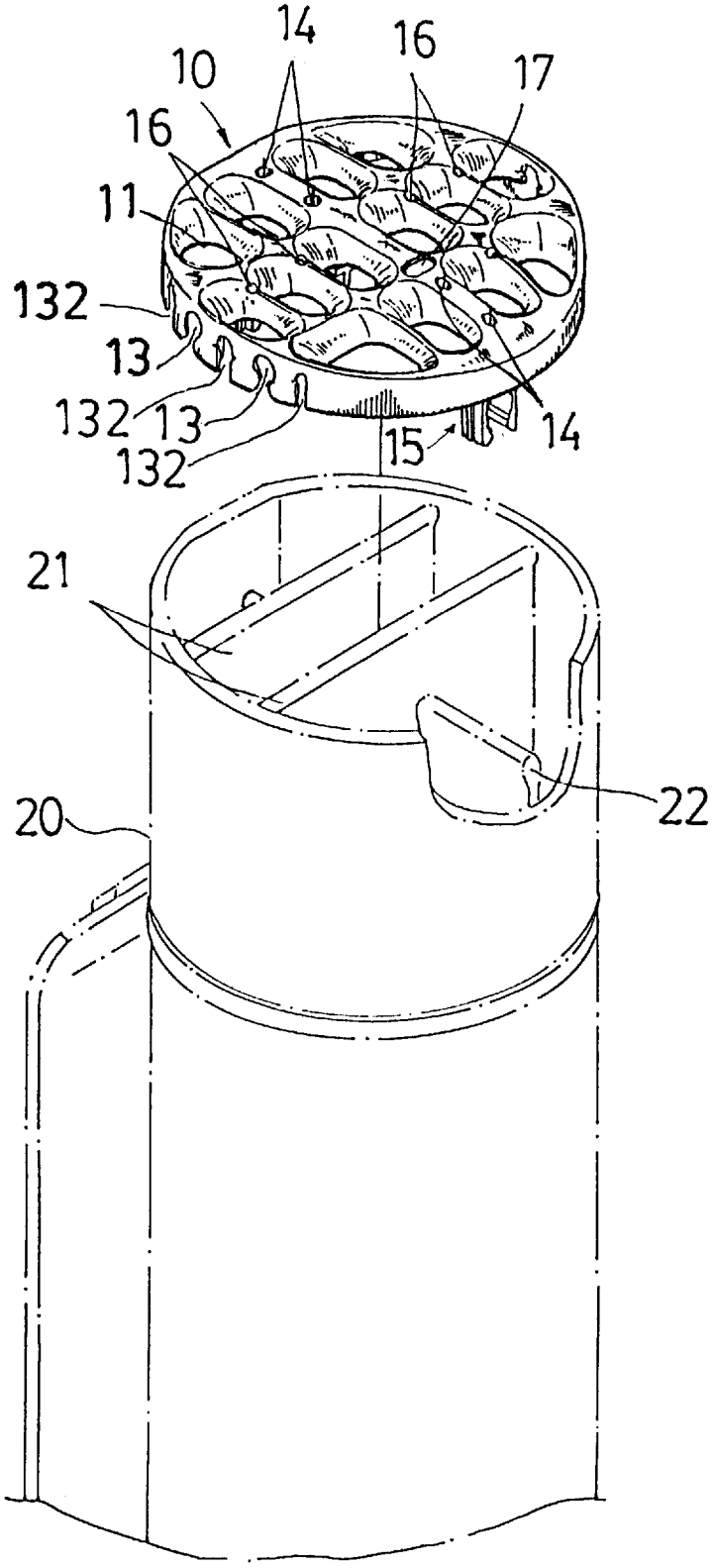
FIG. 4 is an exploded perspective view showing the partitioning bracket and the golf club bag according to the present invention.
Figure 5:
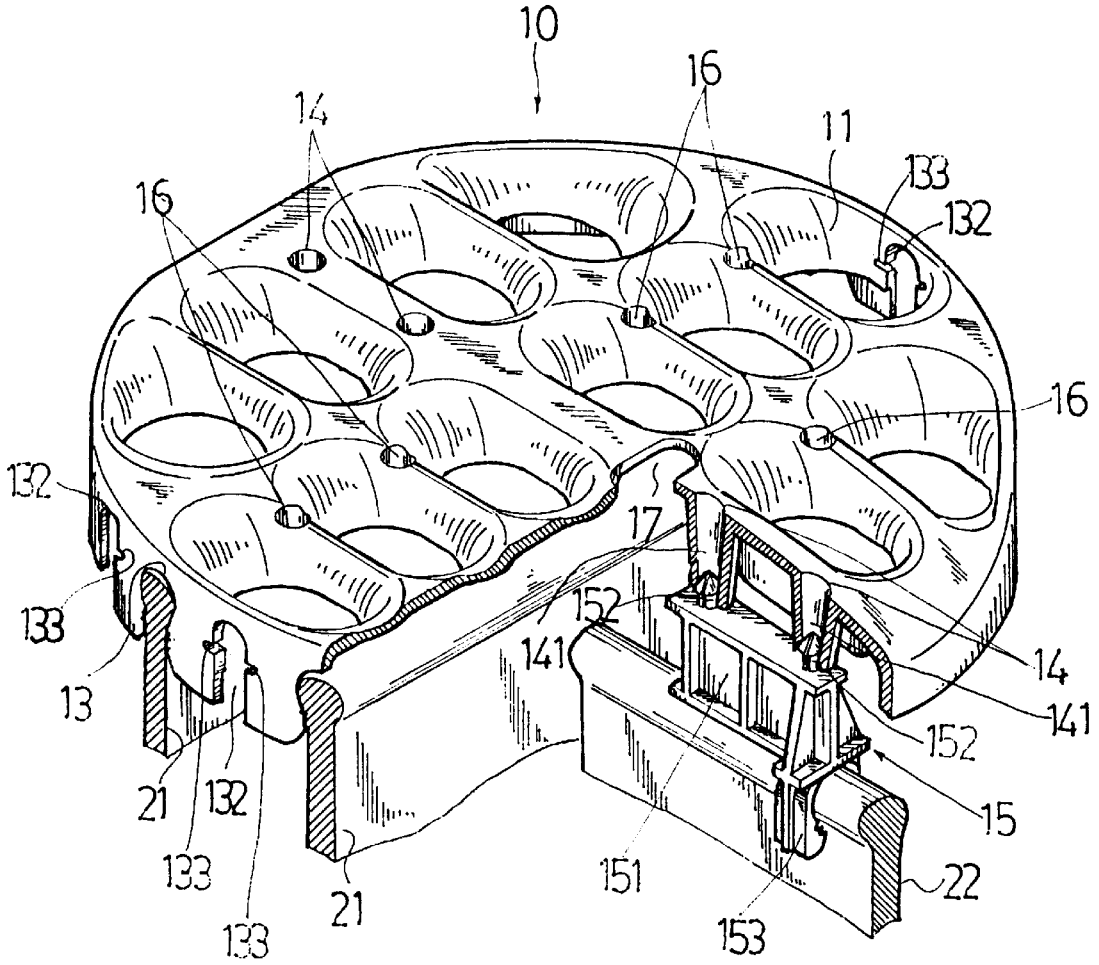
FIG. 5 is a partial cross sectional perspective view of the partitioning bracket and the bag according to the present invention.
Figure 6:
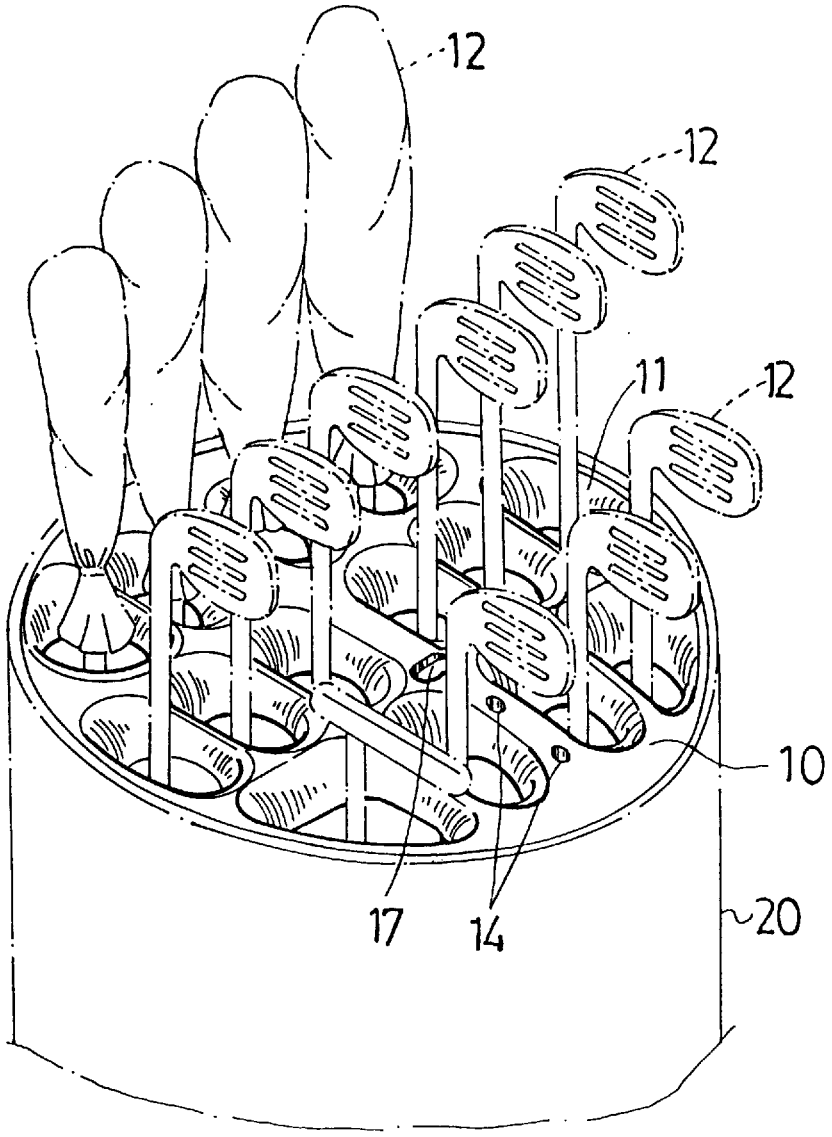
FIG. 6 is a schematic perspective illustration showing each of the golf clubs received within a partitioned chamber defined by the combination of the partitioning bracket and the bag.
Figure 7A:
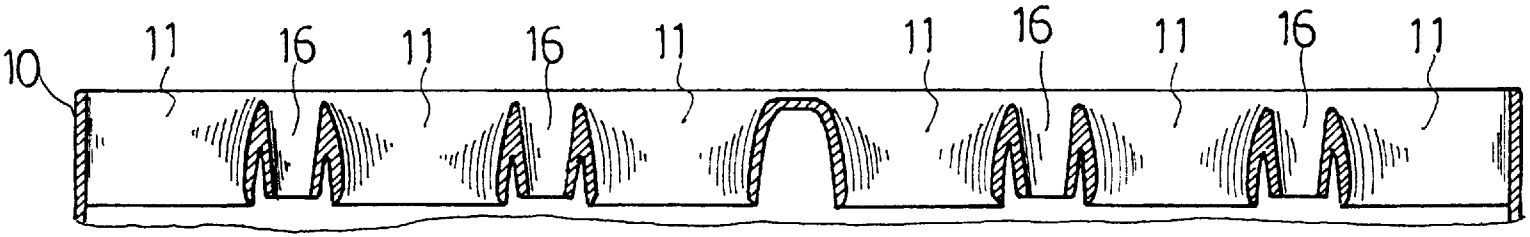
FIG. 7A is a cross sectional view taken along the line A—A in FIG. 3.

Referring to FIGS. 3, 4, 5, 6 and 7A, the partitioning bracket assembly according to the present invention generally comprises a partitioning bracket unit 10 having the shape of a circular disk. The top surface of the bracket unit 10 is defined by a front portion having a circular and inclined shape. The bracket unit 10 is formed with a plurality of openings 11 therein. In this embodiment, there are fourteen (14) openings 11. Each of the openings 11 has an oval shape for readily receiving a golf club 12 therein. The upper and lower portions and the inner periphery of each of the openings 11 are configured in a circular shape for a smooth inserting of a golf club. The left and right portions of the periphery of the bracket unit 10 are each provided with a pair of retaining grooves 13. Each of the retaining grooves 13 is provided with a hooker 131 having a zigzag portion at the lower inner surface. An elongate groove 132 is positioned between two adjacent retaining grooves 13 and at the sides of the retaining grooves 13. The side portion of the elongate groove 132 is provided with a narrow transverse groove 133. The retaining grooves 13 can be engaged by the partitioning plates 21 of the bag 20. When the retaining grooves 13 are engaged with the partitioning plates 21 of the bag 20, the elongate groove 132 and the narrow groove 133 are widely expanded to facilitate the engagement between the retaining grooves 13 and the partitioning plates 21. Each hooker 131 is engaged with a coarse portion of the partitioning plate 21.

The partitioning bracket unit 10 is further provided with a pair of holes 14 which are aligned with each other. Those holes 14 are further extended downward to form a pair of tubular posts 141. Each tubular post 141 is engaged with an insert 152 mounted on a tab 151 of a clip 15. One end of the lower portion of tab 151 is provided with a circular clip 153. The circular clip 153 is provided with a pair of opposed hookers 154 having zigzag portions at the inner ends thereof. The insert 152 can be inserted into the tubular post 141 and the circular clip 153 can be securely engaged with a lower partitioning plate 22 of the bag 20 by circular hookers 153. As an alternative, the clip 15 can be integrally molded with the bracket unit 10.

With the configuration described above, the partitioning bracket 10 can be readily attached to the opening of a golf club bag 20. Each of the openings 11 of the bracket unit 10 only receives a single golf club 12. The oval opening 11 is used to receive a wood therein. The triangular opening 11 is used to receive a putter therein. The opening 11 disposed in the middle area is used to receive an iron therein. Each of the golf clubs 12 is arranged in a neat and smooth manner according to the length of the club.

By this arrangement, clubs 12 will not become entangled or interfere with each other. Because each of the golf clubs 12 is individually disposed in bracket unit 10, clubs 12 can be readily withdrawn therefrom. Each of the openings 11 is provided with a circular periphery portion which may serve as a guide during the withdrawing of the golf clubs 12. By this arrangement, each club 12 can be readily inserted into the opening 11 at different angles and directions. Because each of the clubs 12 is provided with a separate opening 11, the total number of clubs 12 can be readily counted. Besides, since the shaft of each club 12 can reach the bottom of bag 20, each club 12 can be readily and individually recognized by its stored length. Thus, the user will not select a wrong club 12.

Figure 8A:
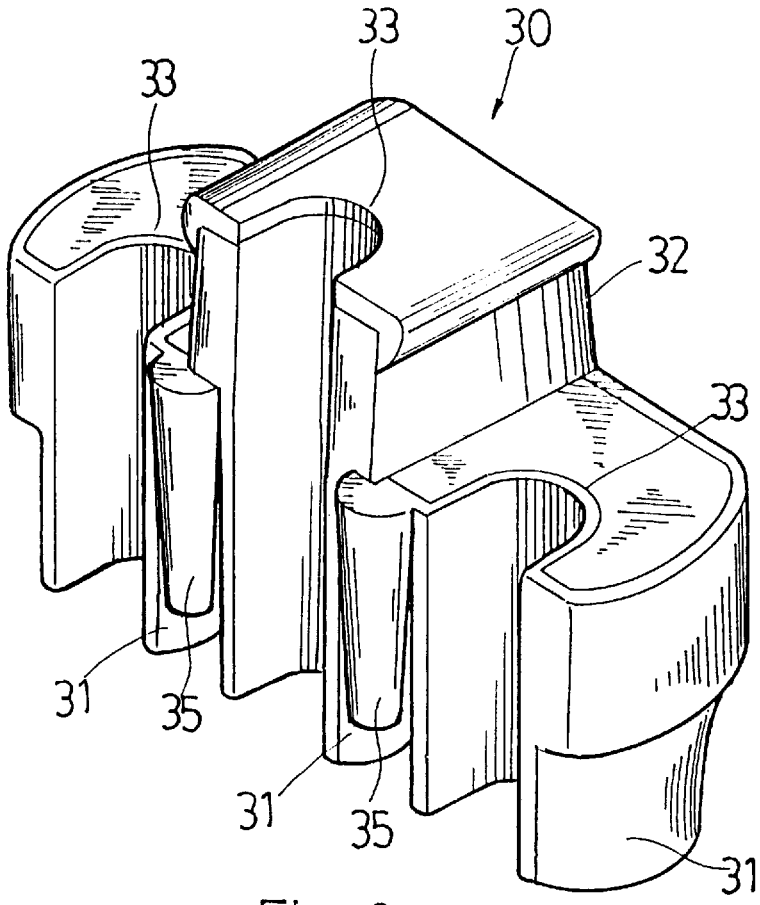
FIG. 8A is a perspective view of the fixing tab according to the present invention.
Figure 8B:
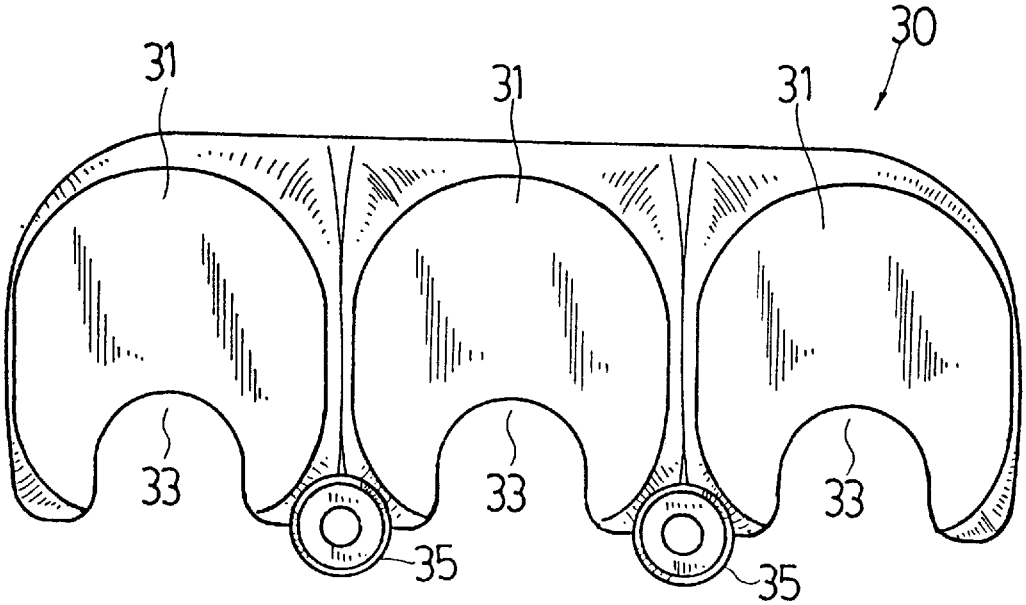
FIG. 8B is a bottom view of the fixing tab according to the present invention.
Figure 11A:
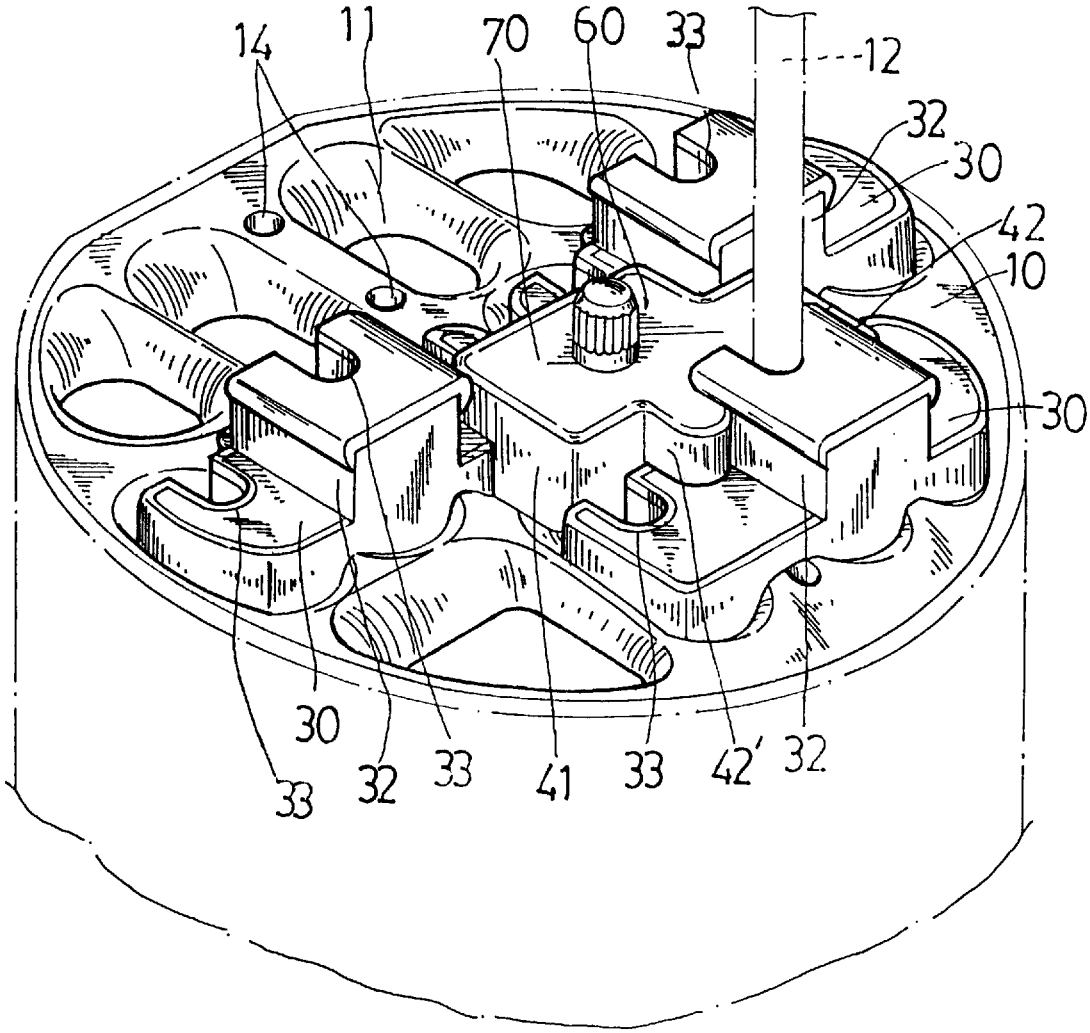
FIG. 11A is a perspective view showing the assembling of the partitioning bracket, the fixing tab and the retainer.
Figure 11B:
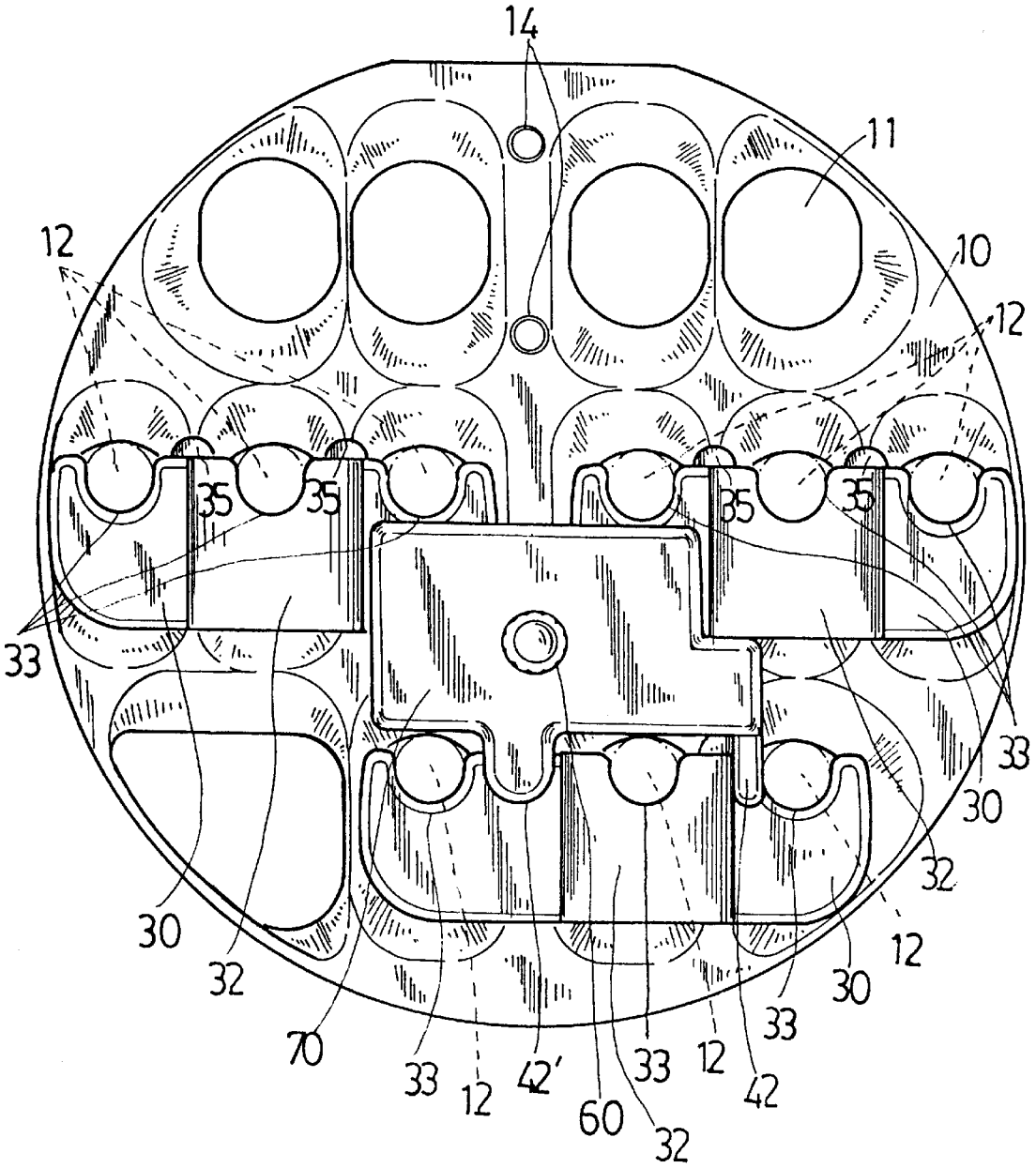
FIG. 11B is a top plan view showing the assembling of the partitioning bracket, the fixing tab and the retainer.

Referring to FIGS. 3, 8A, 8B, 11A and 11B, the openings 11 disposed in the middle and front area of the partitioning bracket unit 10 can be divided into a plurality of sub-groups, each being defined by three openings 11. Each sub-group of openings 11 is provided with a fixing tab 30 for retaining each club 12 which has been inserted into an opening 11. The fixing tab 30 is provided with three anchoring tabs 31 which can be securely retained within the openings 11 of the bracket unit 10. The top of the fixing tab 30 is provided with a handle 32 in a central portion for easy manipulation by the user. Each of the anchoring tabs 31 and the handle 32 is provided with a retaining groove 33 for retaining the shaft of a club 12 therein. The shaft of each club 12 has the same diameter, so each club 12 can be readily retained against movement within a retaining groove 33. In order to prevent the fixing tab 30 from detaching during inclination of the bag 20, a pair of positioning posts 35 are provided between the retaining grooves 33 of the fixing tab 30. The bracket unit 10 is provided with a pair of holes 16 corresponding to positioning posts 35. Accordingly, positioning posts 35 can be readily received unit 10. Each positioning post 35 of the fixing tab 30 disposed at the front portion of the bracket unit 10 is inserted into a corresponding hole 14 of the bracket unit 10.

Figure 9:
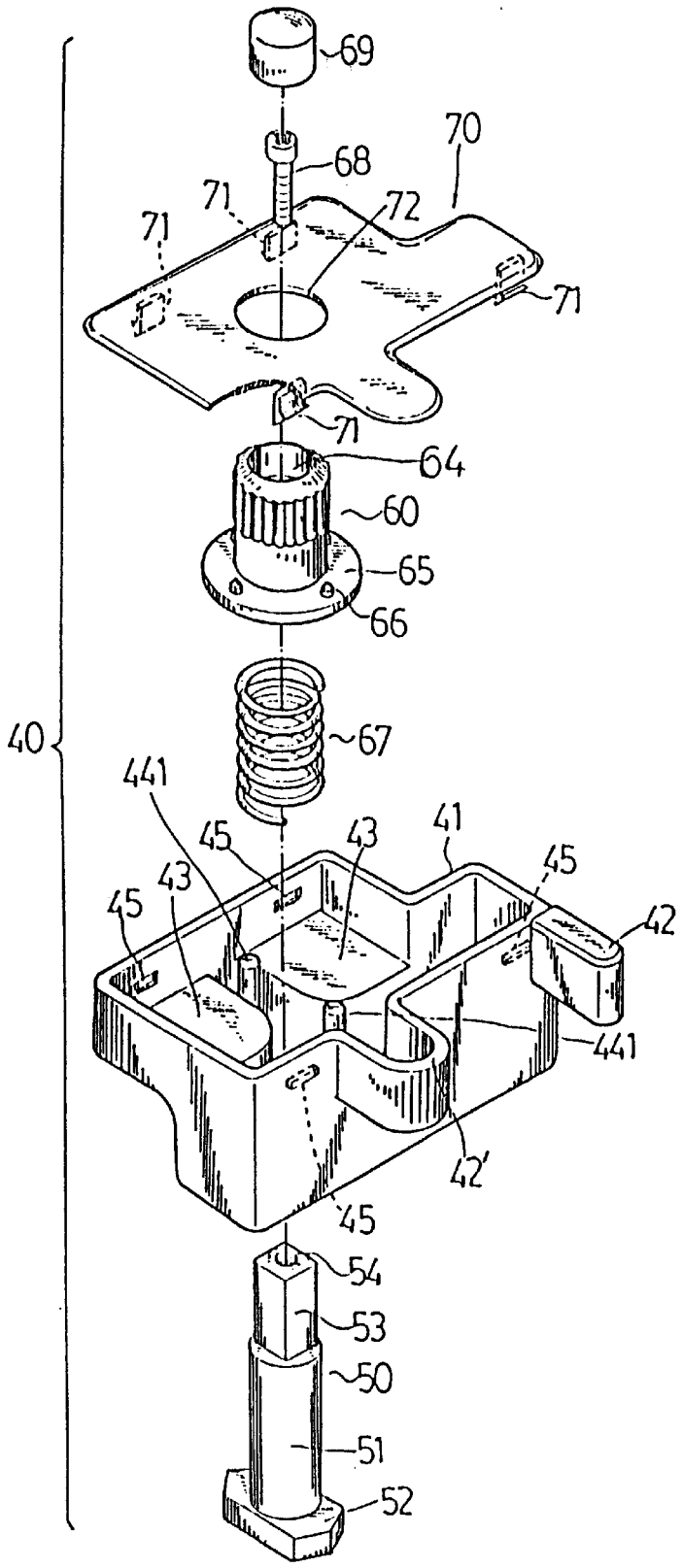
FIG. 9 is an exploded perspective view of the retainer according to the present invention.
Figure 10A:
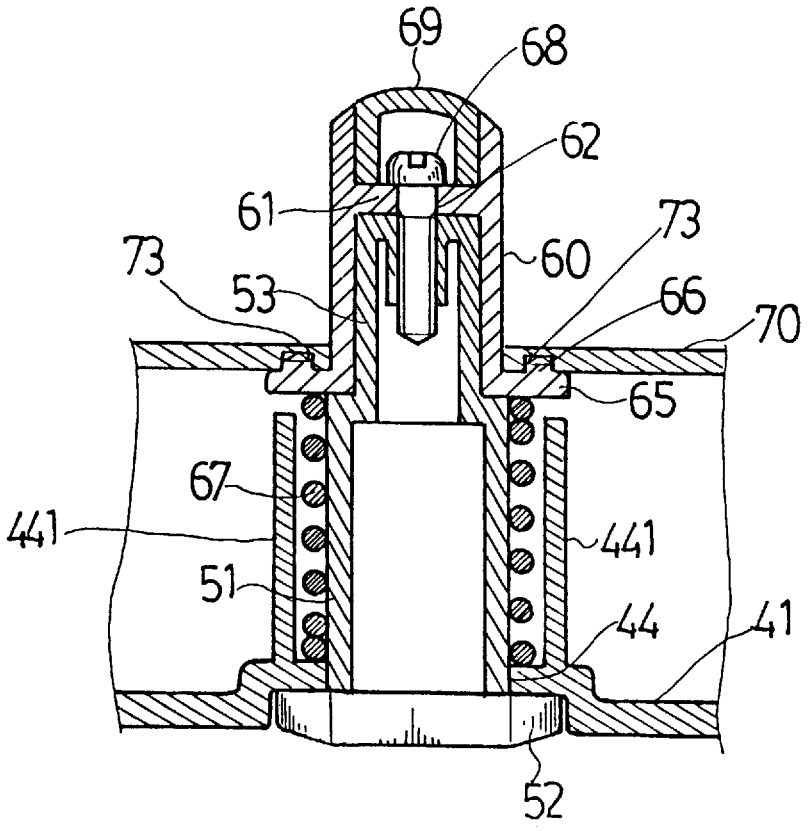
FIG. 10A is a cross sectional view of the retainer shown in FIG. 9.
Figure 10B:
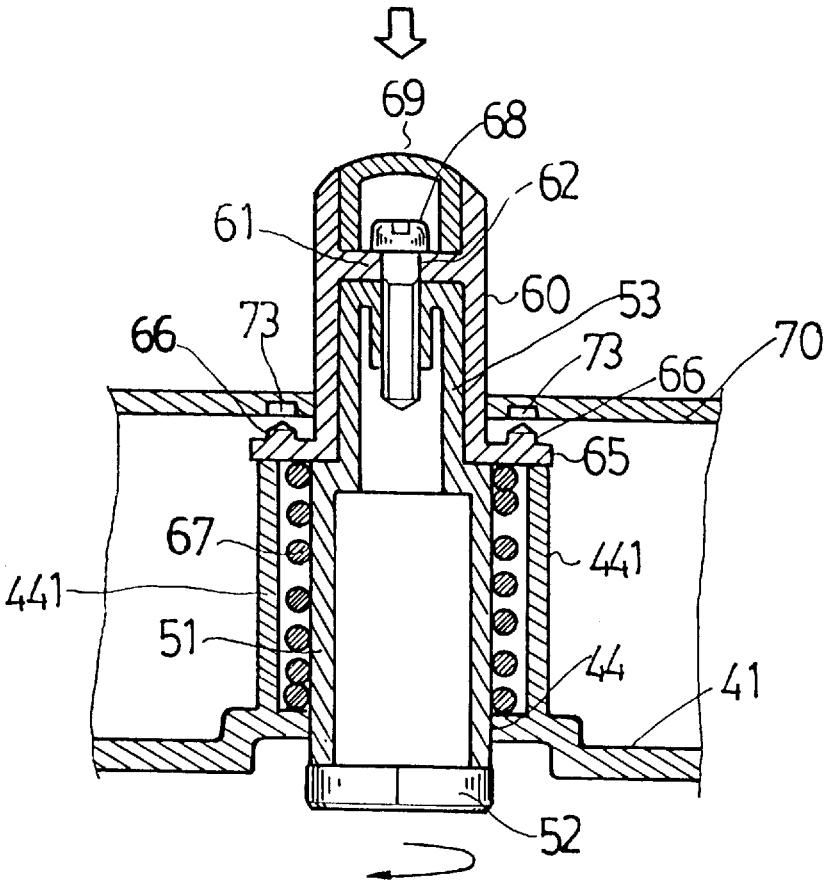
FIG. 10B is a cross sectional view showing the operational movement of the retainer.

Referring to FIGS. 9, 10A, 10B, 11A and 11B, each fixing tab 30 can be further positioned by means of a retainer 40. The retainer 40 is provided with a pressing socket 41 having a preset thickness. The pressing socket 41 is provided with a recessed portion. One side of the pressing socket 40 is provided with a pair of pressing legs 42 and 42'. The opposite side is provided with a pair of retaining blocks 43 at both ends. The bottom center of the pressing block 41 is provided with a hole 44 and a pair of positioning posts 441. The inner periphery of the pressing socket 41 is further provided with a plurality of retaining grooves 45. A latch post 50 is further provided and includes a shaft 51 having a circular cross section. The bottom of the shaft 51 has a fixing flange 52 of an oval shape. The top of shaft 51 is provided with a rectangular post 53 having a keyhole 54. The latch post 50 can be passed through the hole 44 of pressing socket 41 from the bottom to the top thereof and the fixing flange 52 is disposed exteriorly of the hole 44.

A hollow latched post cover 60 is also provided. The periphery of the latched post cover 60 is embossed for manipulating by the user. The latch post cover 60 is further provided with an internal flange 61 having a threaded hole 62 formed therein. The flange 61 forms a partition and the space thereunder defines a rectangular receiving chamber, while the space thereabove has a circular shape. The bottom of the latch post cover 60 has an outwardly extending flange 65 having a plurality of bosses 66 thereon. The bosses 66 are equiangularly disposed. In this embodiment, the bosses 66 are spaced about 90 degrees from each other. The lower receiving chamber of latch post cover 60 receives the rectangular post 53 of the latch post 50. A spring 67 can be disposed between the flange 65 of the latch post cover 60 and the central hole 44 of the pressing socket 41. A latching element 68 is engaged in the threaded hole 62 and the key hole 54 of port 50. By this arrangement, the latch post 50 and the latch post cover 60 can be integrally combined. The circular space 64 of the latch post cover 60 is provided with a sealing plug 69 to cover the latching element 68 and provide the latch post cover 60 with an aesthetic appearance.

A latch post positioning plate 70 is further provided. The positioning plate 70 is configured to correspond to the mouth of the pressing socket 41. A plurality of downwardly extending ribs 71 are further provided to correspond to the retaining grooves 45 and which can be engaged within grooves 45. By this arrangement, the latch post positioning plate 70 can be secured onto the top of the pressing socket 41. The latch post positioning plate 70 is further provided with an opening 72 corresponding in position to the latch post cover 60 for receiving the latter therethrough. The bottom of the latch post positioning plate 70 is further provided with a plurality of recesses 73 corresponding in position to bosses 66. Each of the bosses 66 is further positioned within a corresponding recess 73.

The partitioning bracket unit 10 is further provided with an oval hole 17 in the area between the three fixing tabs 30. The socket 41 receives oval flange 52 of the latch post 50 through the oval hole 17. Finally, the pressing legs 42, 42' of the pressing socket 40 can be engaged against the fixing tab 30 of the partitioning bracket unit 10. On the other hand, the retaining blocks 43 also engage the other two fixing tabs 30 disposed in the middle portion of the bracket unit 10. By pressing down on the latch post cover 60, the downward movement of the post cover 60 can be further limited by the positioning post 441. When the spring 67 is compressed, the bosses 66 are released from the recesses 73 of the latch post positioning plate 70. In this situation, the latch post cover 60 can be smoothly and readily rotated. As the latch post cover 60 is rotated, the latch post 50 is also rotated. When the latch post 50 is rotated through 90 degrees, the oval flange 52 of the latch post 50 will be engaged with narrow portion of the oval opening 17 of the bracket unit 10. When the external force applied to the latch post cover 60 is released, the elastic force of spring 67 moves the latch post cover 60 upward and bosses 66 will be realigned and engaged with the recesses 73. By this arrangement, a plurality of fixing tabs 30 can be engaged by the retainer 40. As a result, the fixing tabs 30 will not become detached. If the user desires to remove the retainer 40, the latch post cover 60 can be rotated through 90 degrees such that the oval flange 52 of the latch post 50 can be aligned with the oval hole 17. Thus, flange 52 can readily pass through hole 17 and the retainer 40 is released therefrom.

When a plurality of golf clubs 12 are sequentially disposed into each of the openings 11 of the partitioning bracket unit 10, each of the clubs 12 can be readily secured by a retaining groove 33 of the fixing tab 30. Then the retainer 40 can be locked up such that each of the fixing tabs 30 can be positioned. Afterward, the bag cap of the golf club bag 20 can be covered thereon and each of the golf clubs 12 are further positioned. By this arrangement, regardless of the position of bag 20, each of the golf clubs 12 will not collide with each other. Furthermore, since each of the golf clubs 12 is suitably isolated from each other, no noise can be heard and the golf clubs can be further protected.

During the playing of golf, the retainer 40 and the fixing tabs 30 can be removed and stored within a small pocket. Then each of the golf clubs can be readily withdrawn therefrom. Even though the retainer 40 and the fixing tabs 30 are removed, the golf clubs 12 are still separated from each other by the openings 11 of the partitioning bracket unit 10. Since each of the openings 12 is provided with a circular periphery and the bottom is also provided with a circular chamfer, the golf club 12 can be readily inserted and withdrawn. The golf club 12 can be disposed within the opening 11 at any angle.

Since each of the openings 11 may receive only one golf club 12, the total number of the golf clubs 12 can be readily counted. Furthermore, the shaft of each of the golf clubs 12 extends to the bottom of the golf club bag 20, and each of the golf clubs 12 can be readily recognized for selection.

According to the present invention, only the front portion and the middle portion of the partitioning bracket unit 10 is provided with retaining tabs 30. This is especially designed so that the woods are disposed within the openings 11 at the rear portion of the partitioning bracket unit 10. According to the existing measurement, each wood club is protected with a special protective bag on the head and the shaft to prevent them from colliding with adjacent woods. As a result, the woods are well protected and a fixing tab 30 is not required. Thus, the fixing tabs 30 and retainer 40 for the woods can be eliminated. The partitioning bracket 10 is engaged onto the partitioning plates 21 and 22 of a conventional golf club bag 20. As a result, the user may simply purchase the partitioning bracket unit 10 and attach same to an existing conventional bag 20.

I claim:

1. A partitioning bracket assembly for a golf club bag in which a plurality of partitioning plates disposed at the top of the golf club bag are provided with a partitioning bracket unit for receiving the golf clubs therein, said partitioning plates being configured by two transverse plate units and a longitudinal traverse plate unit which is disposed at a lower position, the assembly comprising:

said partitioning bracket unit is configured in a circular disk shape, said partitioning bracket unit being provided with a plurality of openings therein and each of said openings being provided with a circular shape at an upper and a lower portion thereof and the inner periphery thereof, each of said openings for receiving one golf club therein;

said partitioning bracket unit being further provided with a pair of retaining grooves respectively at the periphery and which are opposite to each other, an elongate groove between said two adjacent retaining grooves and at each side of said retaining grooves, wherein when said retaining grooves are engaged with said two partitioning plate units of said golf club bag, said elongate grooves are expanded to facilitate the engagement between said retaining grooves and said partitioning plates, said partitioning bracket unit being further provided with a pair of holes which are aligned with each other, said holes being further extended downward to form a pair of tubular posts, each of said tubular post being provided with a clip for attachment to the lower longitudinal partitioning plate unit.

2. A partitioning bracket assembly for a golf club bag as recited in claim 1, wherein said openings disposed in the middle and front areas of said partitioning bracket unit are divided into subgroups which are defined by three openings each, each of said sub-groups of said openings being provided with a fixing tab for retaining each golf club which has been inserted into one of said openings, said fixing tab being provided with a plurality of anchoring tabs which are retained within said opening of said partitioning bracket unit, the top of said fixing tab being provided with a handle at a central portion thereof for manipulation by a user, each of said fixing tabs being provided with a retaining groove for retaining a shaft of said golf club, a pair of positioning posts being disposed between said retaining grooves of said fixing tab, said partitioning bracket unit being further provided with a pair of holes which form a pair of tubular posts corresponding to said two positioning posts, wherein said positioning posts are receivable within said tubular posts for attaching said positioning tabs thereto.

3. A partitioning bracket assembly for a golf club bag as recited in claim 1, wherein a plurality of fixing tabs are jointly retained by a retainer, said retainer comprising:

a pressing socket being provided with a pair of pressing legs at a side thereof, an opposite side of the socket being provided with a pair of retaining blocks at a pair of ends thereof, a bottom center of said pressing socket being provided with a hole, an inner periphery of said pressing socket being further provided with a plurality of retaining grooves;

a latch post being configured in the form of a shaft having a circular cross section, the bottom of said shaft being radially extended with a fixing flange having an oval shape, a top of said shaft being provided with a rectangular post having a keyhole thereon, wherein said latch post is receivable through said central hole of said pressing socket from the bottom to the top and said fixing flange is disposed under said hole;

a hollow latch post cover, said latch post cover being provided with an internal flange having a threaded hole therein, wherein a space under the internal flange has a rectangular receiving chamber and the space above the internal flange has a circular shape, a bottom of said latch post cover forming a flange having a plurality of bosses thereon, wherein said rectangular chamber of the latch post cover receives said rectangular post of said latch post, a spring disposed between said bottom flange of said latch post cover and said central hole of said pressing socket;

a latching element extending through said threaded hole and said keyhole such that said latch post and said latch post cover are securely positioned by the element;

a latch post positioning plate configured to correspond to a mouth of said pressing socket, a hooking rib extending downward and corresponding to said retaining groove and being engageable within said retaining groove for securing said latch post positioning plate onto a top of said pressing socket, said latch post positioning plate being further provided with an opening corresponding to said latch post cover for receiving the cover therethrough, a bottom of said latch post positioning plate being further provided with a plurality of recesses corresponding to said bosses, each of said bosses being further engageable within each of said corresponding recesses, an oval hole being provided at said partitioning bracket unit at a position corresponding to an area between said fixing tabs;

wherein said oval flange of said latch post may be passed through said oval hole of said partitioning bracket unit such that said pressing legs of said pressing socket can engage onto one of said fixing tabs of said partitioning bracket unit and said retaining blocks can engage onto two of said other fixing tabs disposed in a middle portion of said partitioning bracket unit, whereby pressing down said latch post cover and rotating same through 90 degrees, causes said oval flange of said latch post to be engaged with a narrow portion of said oval hole of said partitioning bracket unit to secure said retainer to the bracket unit, and wherein when said latch post cover is rotated through another 90 degrees, said oval flange of said latch post is aligned with said oval hole to release the retainer from the bracket unit.

4. A partitioning bracket assembly for a golf club bag as recited in claim 1, wherein each of said retaining grooves of said partitioning bracket unit is provided with a hook having a zigzag portion at the lower inner surface, and said hooks are opposite to each other.

5. A partitioning bracket assembly for a golf club bag as recited in claim 1, wherein said clip is provided with a tab which is further defined with an insert at both ends at a top portion thereof, one end of a lower portion thereof is provided with a circular clip which is provided with a pair of hooks, each hook having a zigzag portion at an inner end thereof, wherein said insert can be inserted into said tubular post and said circular clip can be fixedly engaged with the lower unit of said partitioning plates of said golf club bag with said circular hooks.

6. A partitioning bracket assembly for a golf club bag as recited in claim 1, wherein the number of said openings of said partitioning bracket unit is about fourteen (14).

* * * * *